US010744068B2

(12) United States Patent
Sita et al.

(10) Patent No.: US 10,744,068 B2
(45) Date of Patent: Aug. 18, 2020

(54) CYLINDRICAL PILL DISPENSER AND RELATED METHODS OF USE

(71) Applicant: AbbVie Inc., North Chicago, IL (US)

(72) Inventors: Lewis H. Sita, Kildeer, IL (US); Bhimaprasad Medhal, Lake Forest, IL (US)

(73) Assignee: ABBVIE INC., North Chicago, IL (US)

( * ) Notice: Subject to any disclaimer, the term of this patent is extended or adjusted under 35 U.S.C. 154(b) by 104 days.

(21) Appl. No.: 16/061,130

(22) PCT Filed: Dec. 11, 2015

(86) PCT No.: PCT/US2015/065310
§ 371 (c)(1),
(2) Date: Jun. 11, 2018

(87) PCT Pub. No.: WO2017/099799
PCT Pub. Date: Jun. 15, 2017

(65) Prior Publication Data

US 2018/0353386 A1 Dec. 13, 2018

(51) Int. Cl.

| | |
|---|---|
| ***A61J 7/00*** | (2006.01) |
| ***A61J 1/03*** | (2006.01) |
| ***A61J 7/04*** | (2006.01) |
| ***A61J 1/14*** | (2006.01) |

(52) U.S. Cl.
CPC ..... *A61J 7/0084* (2013.01); *A61J 1/03* (2013.01); *A61J 1/1418* (2015.05); *A61J 7/04* (2013.01); *A61J 2205/50* (2013.01)

(58) Field of Classification Search
CPC ..... A61J 7/0084; A61J 1/03; A61J 1/1418; A61J 7/04; A61J 2205/50; A61J 7/0076; B65D 83/04
See application file for complete search history.

(56) References Cited

U.S. PATENT DOCUMENTS 2,935,180 A * 5/1960 Von Martens ..... A61J 1/03 206/535
2,953,242 A 9/1960 Kinney
3,095,085 A 6/1963 Meijer
(Continued)

FOREIGN PATENT DOCUMENTS

ES 2 155 036 A1 4/2001
FR 2 928 356 A1 9/2009

OTHER PUBLICATIONS

International Search Report dated Sep. 7, 2016 in International Application No. PCT/US2015/065310.

*Primary Examiner* — Gene O Crawford
*Assistant Examiner* — Ayodeji T Ojofeitimi
(74) *Attorney, Agent, or Firm* — Baker Botts L.L.P.

(57) ABSTRACT

A pill dispenser includes an outer body for displaying one or more pills within the dispenser. A core is disposed within the outer body, and the core includes a channel extending along a length of the outer body to store the one or more pills within the channel. The pill dispenser further includes an actuator with a slot, and the actuator is joined to the outer body at a first end and rotatable about the core from a storage position to a dispensing position with the slot aligned with the channel. An actuator cover is joined to the actuator and includes an opening configured to align with the slot when the actuator is in the storage position.

22 Claims, 12 Drawing Sheets

(56) References Cited

U.S. PATENT DOCUMENTS

| | | | | | |
|---|---|---|---|---|---|
| 3,162,301 | A * | 12/1964 | Cage, Jr. | A61J 7/04 | 206/535 |
| 3,270,915 | A * | 9/1966 | Auer | B65D 83/0418 | 221/2 |
| 3,612,348 | A * | 10/1971 | Thomas | A61J 7/04 | 221/2 |
| 3,654,890 | A * | 4/1972 | Rigney | A61J 7/04 | 116/308 |
| 4,127,190 | A * | 11/1978 | Sunnen | A61J 7/04 | 116/216 |
| 8,152,020 | B2 * | 4/2012 | Flowers | G07F 17/0092 | 221/2 |
| 2005/0029282 | A1 * | 2/2005 | Devine | B65D 83/0409 | 221/289 |
| 2008/0010874 | A1 * | 1/2008 | Londino | A61J 7/04 | 40/310 |
| 2011/0272426 | A1 * | 11/2011 | Ortenzi | A61J 7/0076 | 221/2 |
| 2014/0007806 | A1 * | 1/2014 | Stanton | G09F 3/00 | 116/201 |
| 2014/0339250 | A1 | 11/2014 | Dalpian | | |
| 2016/0130050 | A1 * | 5/2016 | St. Clair | B65D 50/046 | 215/206 |
| 2016/0137391 | A1 * | 5/2016 | Tiesberger | B65D 85/62 | 221/210 |

* cited by examiner

CYLINDRICAL PILL DISPENSER AND RELATED METHODS OF USE

FIELD OF THE DISCLOSED SUBJECT MATTER

The disclosed subject matter generally relates to containers for storing and dispensing medication.

DESCRIPTION OF RELATED ART

Pill dispensers and packages can be designed to facilitate patient compliance with a desired dosing schedule. Such pill dispensers and packages can include a pill configuration, or other indicators, to allow a patient to identify and adhere to a dosing schedule. For example, push and hold dispensing package designs can be utilized by pushing a tablet from a blister pack while pulling and holding a tab of a secondary pack. In this manner, the tablet can be urged through a hole provided in the secondary packaging. In this configuration, the pills can be arranged in a calendar representation to allow the user to track the dosage schedule. Alternatively, in a squeeze and pull design, a user can dispense a dose by simultaneously squeezing tabs at each side of the package while pulling a blister pack out. In this manner, after pulling out the blister pack, the patient can push on a tablet from the blister pack to remove the pill, and then re-insert the blister pack in the package for seamless storage.

However, there remains a continued need for improved containers and techniques. For example, there remains a need for containers and techniques to allow the user to more easily detect a missed dose or an incorrect dose. Additionally, it can also be desirable for such containers to be simple to operate with less dexterity and/or force, for example by elderly or disabled persons.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a pill dispenser for storing pills and dispensing each pill one a time with simple patient actions. The pill dispenser includes an outer body for displaying one or more pills within the dispenser. A core is disposed within the outer body, and the core includes a channel extending along a length of the outer body to store the one or more pills within the channel. The pill dispenser further includes an actuator with a slot, and the actuator is joined to the outer body at a first end and rotatable about the core from a storage position to a dispensing position with the slot aligned with the channel. An actuator cover is joined to the actuator and includes an opening configured to align with the slot when the actuator is in the storage position.

As embodied herein, the outer body includes a first column of outer windows that are configured to be aligned with the channel of the core. The outer windows are configured to display the one or more pills therethrough. The outer body further includes a second column of outer windows that are configured to display an indicator proximate each window of the first column of outer windows. The core of the dispenser includes a plurality of channels extending along a length of the outer body, the plurality of channels spaced apart about the circumference of the core, each configured to store one or more pills. The actuator includes a groove, and a spring is disposed within the groove, configured to return the actuator to a storage position after actuator is rotated to the dispensing position. The groove includes a recess to receive a nub disposed on a corresponding side of the actuator cover. The actuator cover includes a locking rod that is inserted into an aperture within the actuator. In some embodiments, the stored pills are dispensed through the actuator slot and the opening of the actuator cover.

As further embodied herein, the dispenser can include a calendar sleeve disposed between the outer body and the core. The calendar sleeve includes one or more columns of pill windows and an indicator disposed proximate each pill window. The outer body can include a first column of outer windows configured to be aligned with one of the columns of pill windows, and a second column of outer windows configured to be aligned with the corresponding indicators of the pill windows. The calendar sleeve includes teeth configured to engage corresponding teeth of the outer body. When the teeth are disengaged from the corresponding teeth of the outer body the calendar sleeve is rotatable within the outer body.

As further embodied herein, the dispenser includes a shaft disposed within the core and a knob configured to engage with the core proximate an opposing end of the outer body and releasably engage with the shaft. The shaft includes teeth spaced circumferentially around the shaft and protruding radially therefrom. The knob includes teeth configured to be releasably engaged with the teeth spaced circumferentially around the shaft. The actuator cover engages the shaft at the first end of the dispenser. When the knob is disengaged from the shaft, the knob is rotatable by a user to rotate the core to align a selected channel with the actuator's slot when the actuator is in a dispensing position.

It is understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the disclosed subject matter. Together with the description, the drawings serve to explain the principles of the disclosed subject matter.

Figure 1A:
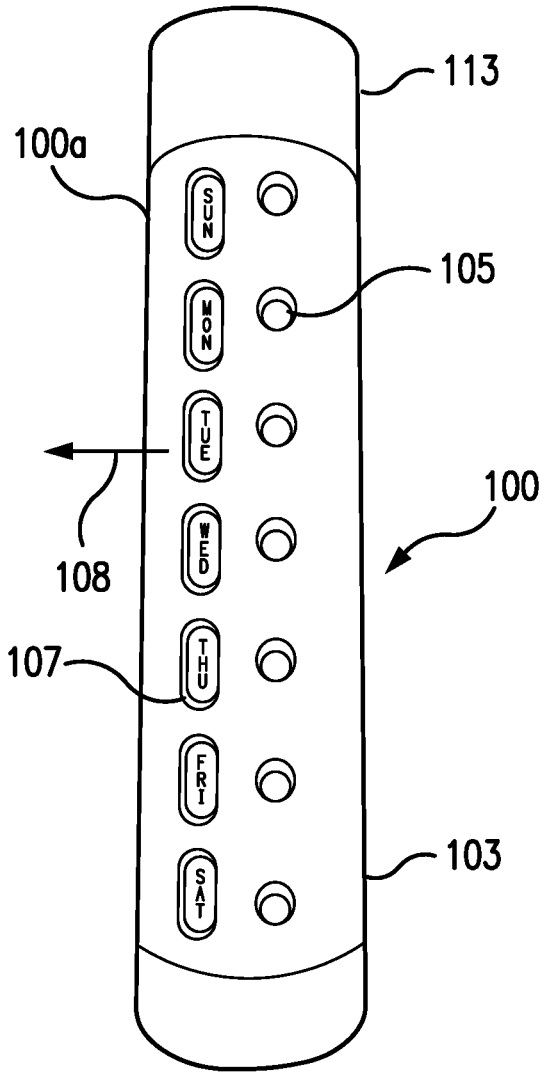
FIG. 1A is a front view of an exemplary dispenser in accordance with the disclosed subject matter, where the dispenser stores and dispenses pills for a daily regimen, according to an illustrative embodiment of the disclosed subject matter.

It will be appreciated that for simplicity and clarity of illustration, elements shown in the figures have not necessarily been drawn to scale. For example, the dimensions of some of the elements can be exaggerated relative to other elements for clarity. Further, where considered appropriate, reference numerals can be repeated among the figures to indicate corresponding or analogous elements.

DETAILED DESCRIPTION

The apparatus and methods presented herein can be used for storing and dispensing medication to a patient in an easily controlled manner and in accordance with a desired dosing schedule. As used herein, a "dispenser" or "pill dispenser" (used interchangeably herein) is intended to refer generally to a device to assist an individual (also referred to herein as a user or a patient) to store and/or carry beneficial agents, therapeutics, medication, drugs, or other consumable products which can be in the form of pills, tablets, capsules or the like. The dispenser can also dispense or provide the stored medication to the patient for the consumption in a measured dose (e.g., a number of pills over a period of time). The dispenser can also provide an indication of how many pills a patient has taken and/or will need to take over a certain time periods (e.g., days, weeks, months, etc.). The dispenser can be used to dispense a wide range of desired items, including therapeutic or beneficial products. Such products can be in the form of pills, capsules, tablets or other recognized dose forms. As used herein, and unless otherwise noted, the term "pill" is to be interpreted broadly to include all such recognized or desired forms.

A dispenser according to the disclosed subject matter can include indicators to a patient to more easily detect a missed dose or an incorrect dose of medication, and thus can facilitate compliance with treatment instructions. For example, a cylindrical pill dispenser can stack 7 days of pills in a column, and a plurality of columns can be arranged in a radial array to achieve a 6-week or 1-month supply, for example and as embodied herein. A dispenser can be configured to dispense a predetermined dose (e.g., a single pill) over a predetermined time period (e.g., a single day). The pill dispenser can also be configured to allow a patient to determine whether the predetermined doses have been dispensed over a period of time (e.g., one pill a day, two pills a day, one pill every 12 hours). Additionally, the dispenser can be easy to use by patients having hand mobility problems, e.g., elderly or disabled patients. For example, and as embodied herein, a patient can view a visual indication on the dispenser to determine, for example and without limitation, how many doses are remaining, how many doses have been taken, and whether a dose has been missed. The pill dispenser can thus facilitate patient compliance with medical prescription instructions.

Embodiments of the disclosed subject matter can include a pill dispenser having a cylindrical shape so as to be discreetly carried by the patient, such as in a purse or a pocket. The dispenser can include, for illustration and not limitation, an outer body or shell for displaying one or more pills within the dispenser. The outer body can include a set of windows or apertures to reveal the amount of pills contained within the dispenser. One or more indicators can be seen from the exterior of the dispenser to aid a patient in tracking the number or dose of pills that have been taken or consumed. The indicators can indicate a day or time period associated with each dose or pill. A core or column can reside within the outer body of the dispenser to store one or more of the remaining pills in a stacked formation. The core can include one or more channels extending longitudinally along the length of the outer body. The dispenser can include an actuator at one end of the dispenser, and the actuator can be partially mated with or attached to the outer body and rotatable about the dispenser.

By way of illustration and not limitation, the actuator can include one or more slots. The actuator can be rotated to align the slot of the actuator with at least one of the channels in the core. In this manner, the channel can be in an "open" configuration relative the actuator, and the pills stored in the open channel can be removed, for example and as embodied herein, by tilting the dispenser to urge a single pill through the slot in the actuator. The actuator can be rotated in an opposite direction to urge the slot out of alignment with the channel. In this manner, no further pills can be dispensed into the actuator without further rotation or twisting of the actuator. The patient can retrieve the dispensed pill by tilting the dispenser and removing the dispensed pill from the slot.

The patient can view an indicator on the dispenser to determine a number of pills remaining in the dispenser by looking through the windows or holes of the outer body. For example, and as embodied herein, remaining pills can be seen through the windows or holes of the outer body, and the remaining windows or holes can show an empty core. The outer body can include a day indicator, for example proximate each of the windows or apertures, which can include an indication or label for each day of the week, e.g., as an abbreviation for days Sunday through Saturday. The arrangement of the days on the outer body can be configured by the patient, as described further herein. Alternatively, other indicators can be used, for example and without limitation, to indicate hours, weeks or months.

In accordance with the disclosed subject matter herein, the disclosed subject matter includes a dispenser. The pill dispenser includes an outer body for displaying one or more pills within the dispenser. A core is disposed within the outer body, and the core includes a channel extending along a length of the outer body to store the one or more pills within the channel. The pill dispenser further includes an actuator with a slot, and the actuator is joined to the outer body at a first end and rotatable about the core from a storage position to a dispensing position with the slot aligned with the channel. An actuator cover is joined to the actuator and includes an opening configured to align with the slot when the actuator is in the storage position.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the pill dispenser are shown in FIGS. 1-11. While the present disclosed subject matter is described with respect to using the device to provide medicine in pill form to a patient, one skilled in the art will recognize that the disclosed subject matter is not limited to the illustrative embodiment, and that the dispenser can be used to store and dispense any suitable substance into a user, including any nutritional or pharmaceutical products. In addition, the components and the method of using the dispenser are not limited to the illustrative embodiments described or depicted herein.

Figure 1B:
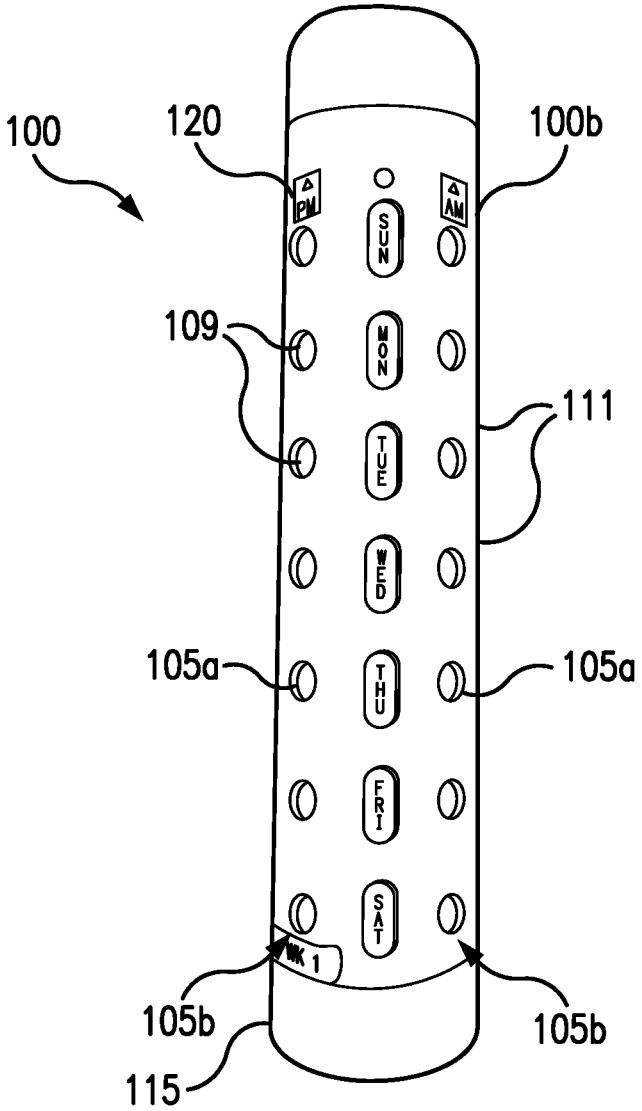
FIG. 1B is a front view of an exemplary dispenser in accordance with the disclosed subject matter, where the dispenser stores and dispenses pills for a twice-daily regimen, according to an illustrative embodiment of the disclosed subject matter.

With reference to FIGS. 1A-1B, an exemplary assembled pill dispenser 100 is provided. For the purpose of illustration and not limitation, the dispenser 100 can have a substantially cylindrical shape and include an outer body 103 or shell that is cylindrical or substantially cylindrical. For example, and as embodied herein, the outer body 103 can be a hexagonal or octagonal prism. The outer body 103 can include a number of windows 105 or apertures to allow a patient to view remaining pills stored within the dispenser. Additionally, and as embodied herein, each window 105 can be disposed proximate to and aligned with a corresponding day indicator 107, which can indicate a time interval in which to dispense and consume a dose. The windows 105 can also be configured to align with, for example and as embodied herein, a channel or chamber within the dispenser configured to store pills (a channel may be shown by channel 406 of FIGS. 6A-6B). For example, and as embodied herein, the windows 105, channel, and indicators 107 can be in radial alignment, each at least partially overlapping each other and facing outwardly in a radial direction 108 from an interior of the dispenser.

As shown for example in FIG. 1A, and as embodied herein, a dispenser **100*a* can be configured for daily pill dosage. In this configuration, outer windows 105 each can align with one of seven daily doses of pills stored within the dispenser 100*a* corresponding to a week's regimen, and each outer window 105 can be disposed proximate to and aligned with a corresponding day indicators (e.g., seven day indicators 107 representing one week). Alternatively, as shown for example in FIG. 1B, and, a dispenser 100*b* can be configured for twice daily pill dosage. Twice daily pill dispenser 100*b* can include outer windows 105 disposed proximate to and aligned with either a morning dose of pills 109 or an evening dose of pills 111 each stored within the dispenser. As such, each pill window 105*a* can align with a corresponding day indicator 107 and a corresponding time of day indicator 120, which can include, for example and as embodied herein, an "AM" and "PM" indicator corresponding with each column 105*b* of outer windows 105*a***. Dispensers according to the disclosed subject matter can be configured to dispense any number of pills, e.g., one, two or more pills, over any time period, e.g., any number of hourly, daily or weekly increments.

Additionally, and as embodied herein, dispenser 100 can include a top cap 113 and a bottom cap 115, which can engage the outer body 103 by any suitable engagement, for example and as embodied herein, a threaded engagement. The top cap 113 can receive and cover at least a portion of an actuator, which can be utilized to dispense pills as described further herein, and the bottom cap 115 can receive and cover a reset knob, which can be utilized to reset a calendar, as described further herein with respect to FIGS. 9-11. The top cap 113 and bottom cap 115 can provide a smooth exterior finish for the dispenser, and can prevent inadvertent access to the actuator or reset knob, for example to prevent unintentional dispensing of pills or resetting of the calendar.

Figure 2A:
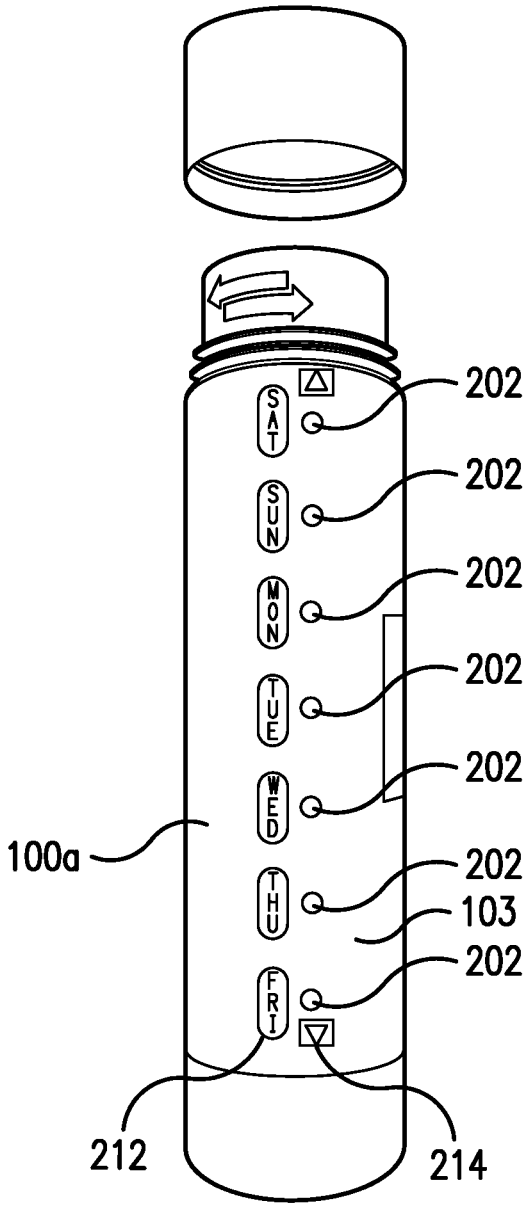
FIG. 2A is an exploded view of the dispenser of FIG. 1A, having a dosing regimen stored therein.
Figure 2B:
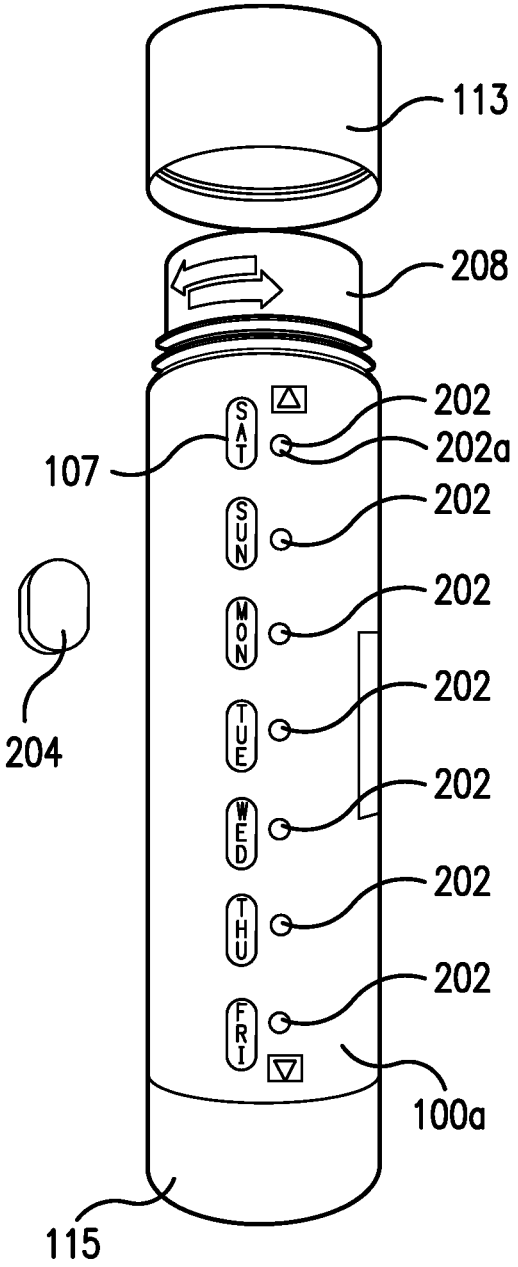
FIG. 2B is an exploded view of the dispenser of FIG. 1A, illustrating a single dose dispensed therefrom.

With reference to FIGS. 2A-2B, a dispenser **100*a* configured to store and dispense pills and provide an indication of dispensed pills is illustrated. For the purpose of illustration and not limitation, a dispenser 100*a* storing a full week of pills can show a pill through each of the seven windows 202 to allow a patient to determine that the dispenser 100*a* is full. Windows 202 can be arranged in any suitable manner, for example, windows 202 may be arranged in a column 214. In some examples, the windows may be formed using a transparent or semi-transparent material to display the pills. Alternatively, the windows 202 can be configured as transparent or translucent features such as by injection molding processes or the like in the outer body or shell 103 of the dispenser 100*a*. A user may dispense a pill 204 from the dispenser 100*a*, e.g., by unscrewing a top cap 113 and rotating an actuator 208, and a window 202*a* and day indicator 107 (e.g., shown in FIG. 2B as "Saturday") associated with the dispensed pill can appear as an empty space proximate the indicator 107 as the pill 204 is no longer viewable through the window 202. Other windows 202 can display the stored pills remaining in the dispenser 100***a* for the remaining days of the week. As shown, day indicators 107 can be arranged in a manner corresponding to the windows 202, for example, day indicators 107 may be arranged in a column 212. In some examples, the day indicators may be arranged with later days or times towards the bottom cap 115 of the dispenser, and earlier days or times towards the top cap 113.

Figure 3A:
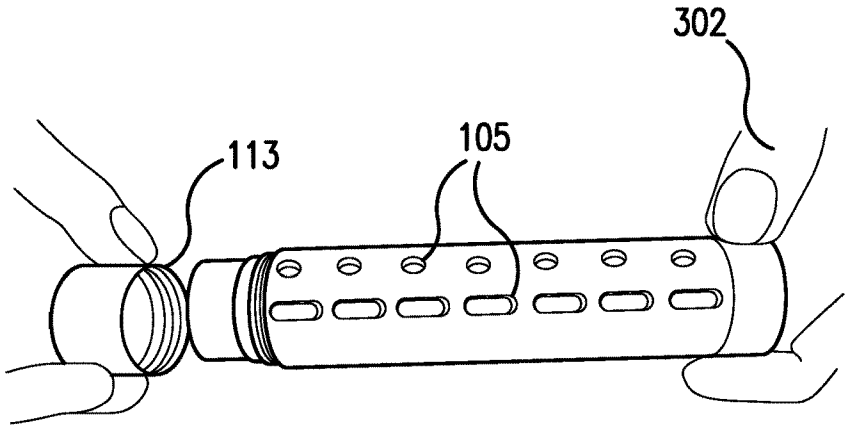
FIGS. 3A-3D are representative images illustrating an exemplary method for dispensing pills, using the dispenser of FIG. 1A, including removing the cap (FIG. 3A), turning the actuator to dispense a pill (FIG. 3B), returning the actuator to a storage position (FIG. 3C), and securing the pills and dispenser by replacing the cap (FIG. 3D).
Figure 3B:
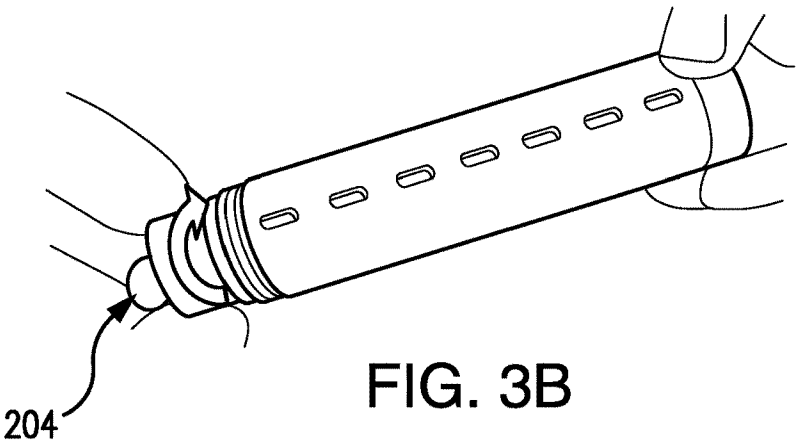
Figure 3C:
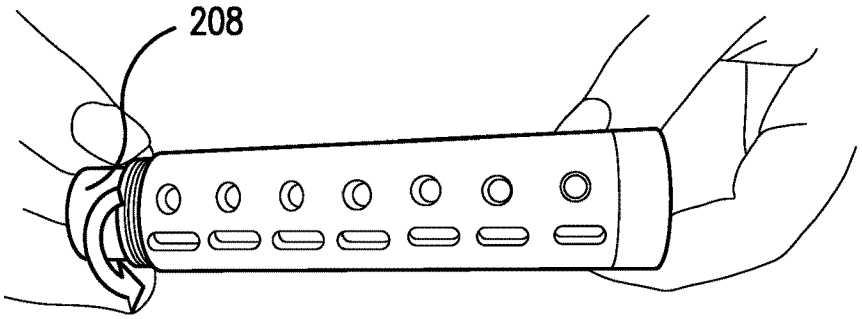
Figure 3D:
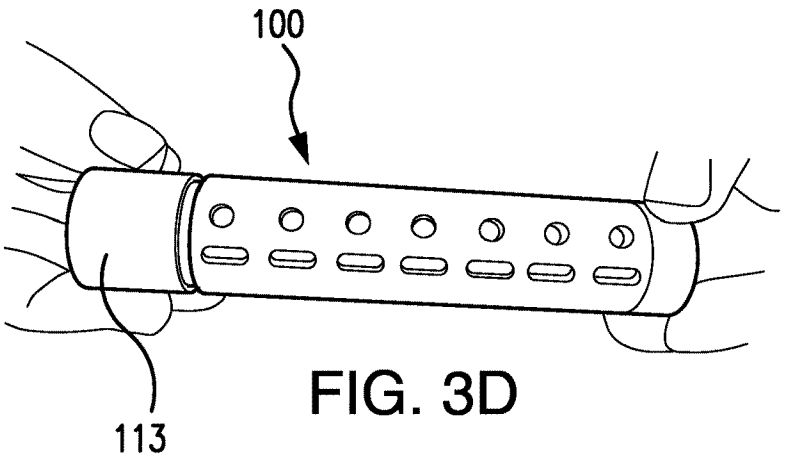

With reference to FIGS. 3A-3D, an exemplary method for dispensing pills using a dispenser 100 is provided. For purpose of illustration, and not limitation, as embodied herein, dispenser 100 can include an outer body 103 with the set of windows 202 formed through the outer body 103. The one or more pills can be stored in a first channel of a core within the outer body, wherein the channel is oriented along the length of the outer body 103 (as shown for example in FIG. 6). With reference to FIG. 3A, a user 302, such as a patient (or a doctor, nurse, or health aide, for example) can initially remove a top cap 113 from one end of the dispenser, for example and as embodied herein, by unscrewing a threaded engagement. Referring now to FIG. 3B, user 302 can rotate an actuator 208 (as shown in FIG. 3C) at the one of the dispenser 100, as embodied herein proximate the engagement for the top cap. The rotation of the actuator 208 can align a slot 702 (shown in FIG. 7A) in the actuator with the first channel of the core to allow a pill 204 to pass from the core into the slot. Referring now to FIG. 3C, the actuator can be rotated in the opposite direction to return the actuator to a storage position, and the patient can tilt the dispenser 100 to remove the pill 204 from the slot in the actuator 208. The second rotation of the actuator can be by the user's 302 action, or can be automatic through a biasing mechanism, such as a spring. The return of the actuator 208 to a storage position can offset the slot within the actuator 208 from the first channel of the core, and can align the slot within the actuator 208 with an opening of an actuator cover to allow the user 302 to remove the pill 204 from the actuator's 208 slot and into the patient's hand. With reference to FIG. 3D, the user 302 can re-engage the top cap 113 onto the dispenser 100.

Figure 4B:
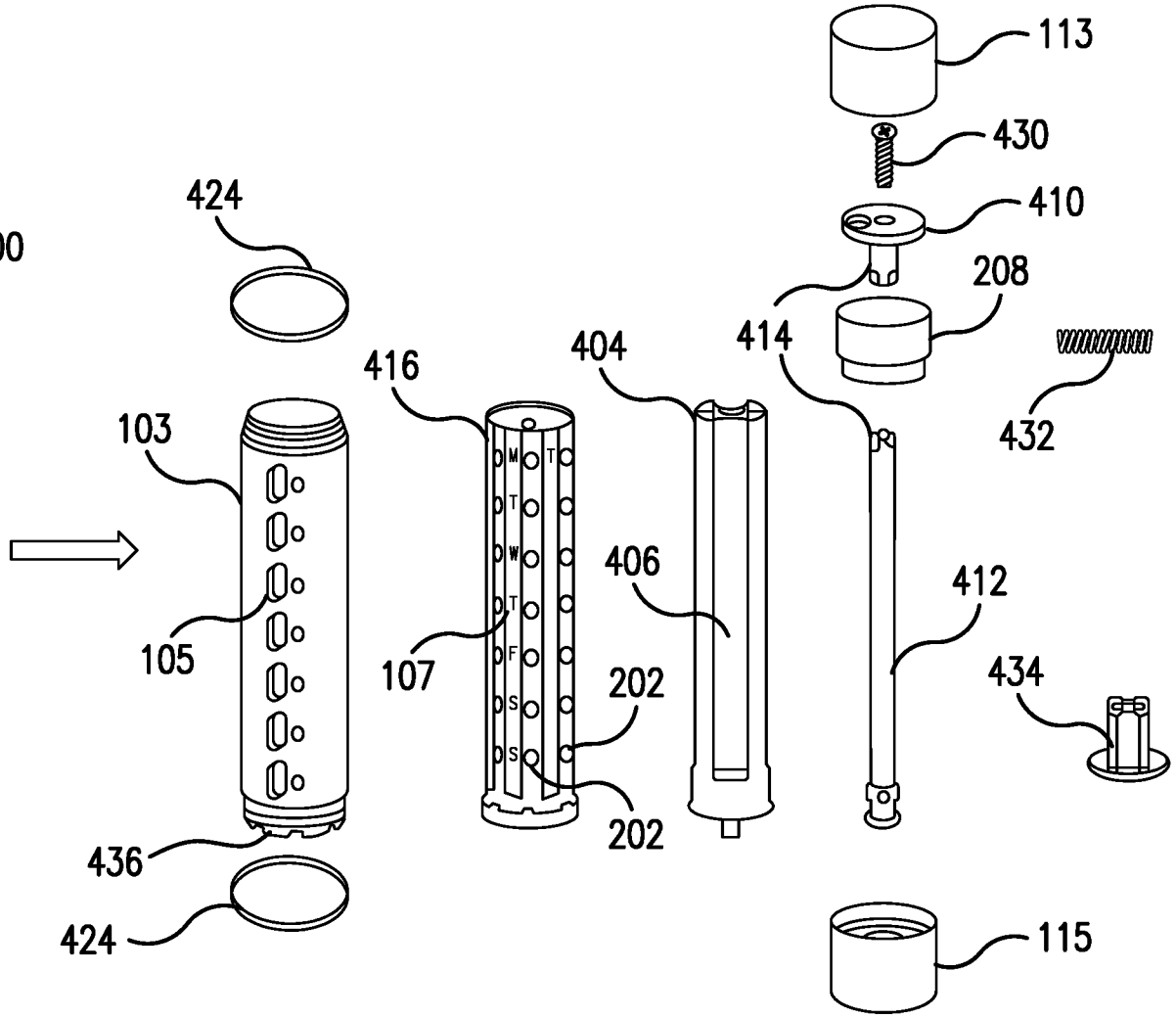
FIG. 4B is an exploded view of the pill dispenser of FIG. 1A unassembled to depict the various components.
Figure 4A:
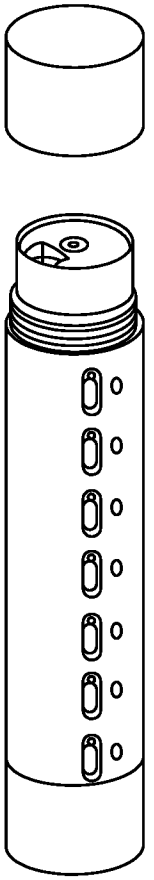
FIG. 4A is an exploded view of the pill dispenser of FIG. 1A with the cap removed.

With reference to FIG. 4A, exemplary components of a pill dispenser of the disclosed subject matter are illustrated. Pill dispenser 100 can include, for the purpose of illustration not limitation, a cylindrical outer body 103 configured to display one or more pills within the dispenser 100 therethrough. A core 404 can be disposed within the outer body 103, and as embodied herein, can include one or more channels 406 to store the one or more pills. The one or more channels 406 can extend along the length of the outer body 103 and dispenser 100. For a plurality of channels 406 in the core 404, the channels 406 can be arranged radially around the core 404 to display the stored pills through the outer body 103. An actuator 208 including a slot can be disposed at one end of the dispenser 100 and aligned with the channels 406 to allow rotation of the actuator to align the slot with one of the channels 406 storing the pills, as described herein. The actuator 208 can be configured to automatically return to an original position after rotation, for example and without limitation, and as embodied herein, by spring 432 disposed within actuator 208. An actuator cover 410 can secure the actuator 208 to the dispenser 100 while allowing the actuator 208 to rotate. For example, and as embodied herein, the actuator cover 410 can be locked with a shaft 412 or knob holder engaging and disposed through the core 404. As embodied herein, the actuator 208 and actuator cover 410 can be disposed proximate an upper end of the dispenser. For example, and as embodied herein, shaft 412 can be configured to be engaged with the actuator cover 410 through interlocking teeth 414 and/or through an adhesive applied proximate the actuator 208. Additionally, and as embodied herein, a reset knob 434 can be disposed at an opposing end of the dispenser 100 from the actuator 208 and be configured to engage the core 404 to rotate the core 404 to allow dispensing of pills stored in a different channel 406 of the core 404. The reset knob 434 can further be configured to be locked and unlocked with the shaft 412. As embodied herein, the reset knob 434 can be disposed proximate a lower end of the dispenser.

With continued reference to FIG. 4B, and as embodied herein, a calendar sleeve 416 can be placed between the outer body 103 and the core 404, and the calendar sleeve 416 can include one or more columns of pill windows 202 and a day indicator 107 associated with each window 202. The outer body 103 can include outer windows 105 positioned along the length of outer body 103. When assembled, outer windows 105 can align radially with the columns of pill windows 202 on the calendar sleeve 416, and each window 105 can be disposed proximate a corresponding day indicator 107.

For purpose of illustration and not limitation, and as embodied herein, dispenser 100 can include O-rings 424 at the top and bottom end of the outer body 103 to improve sealing or fastening of the top cap 113 and bottom cap 428. The O-rings 424 can further provide a barrier from oxygen and moisture reaching the interior of the dispenser 100, which can improve shelf-life and usage life of the stored pills. A fastener, such as screw 430 can also be provided to secure the actuator cover 410 to the shaft 412, which can hold dispenser 100 in an assembled condition.

Figure 5:
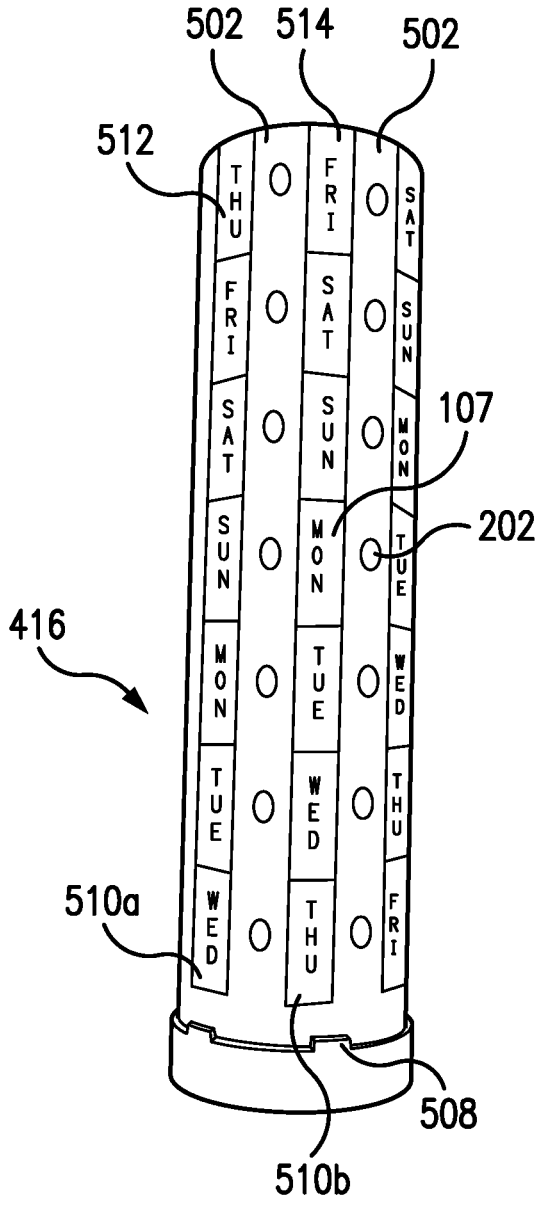
FIG. 5 is a front view of an exemplary embodiment of a calendar sleeve in accordance with the disclosed subject matter.

Referring now to FIG. 5, an exemplary calendar sleeve 416 is illustrated. Calendar sleeve 416 can include one or more columns of pill windows 502. For purpose of illustration and not limitation, as embodied herein, each column 502 can correspond with a week. However, it is recognized that any suitable units can be displayed in the window and column arrangements for the pills to be dispensed. Each window 202 can be associated with or labeled with a corresponding indicator 107, which as embodied herein, can indicate a date or a day of the week. The calendar sleeve 416 can be disposed between the outer body and the core such that the calendar sleeve 416 is disposed within the outer body of the dispenser. For example, and as embodied herein, one of the columns 502 of the calendar sleeve 416 can be aligned with at least some of the outer windows on the outer body. As shown in FIG. 2A, for example, an outer body 103 can include a column of outer windows 214 to display a pill therethrough and a corresponding column of outer windows 212 to display the indicator 107 on the calendar sleeve 416. As such, one of the columns 502 of the calendar sleeve 416 can be aligned with pill windows 202 for pill display, and the respective day indicators 107 of the calendar sleeve 416 can be aligned with the column of outer windows 105 for indicator display.

With continued reference to FIG. 5, as embodied herein, calendar sleeve 416 can be aligned at a radial position within the outer body such that outer windows 105 (as shown for example in FIG. 4) are radially aligned with pill windows 202 to allow a pill stored within the dispenser to be viewable through the outer body 103. The calendar sleeve 416 can be configured to be engaged with the outer body 103 through interlocking teeth 508 on bottom of the calendar sleeve 416. As embodied herein, the calendar sleeve 416 can be disposed within the outer body 103, and the calendar sleeve 416 can be engaged with the outer body 103 through exterior locking teeth 436 on the outer body 103 (as shown for example in FIG. 4) engaged with interlocking teeth 508. The patient can update or change the day, date, or time of prescription regimen, for example and as embodied herein, by pulling the interlocking teeth 508 outward along the length of the outer body 103 to disengage exterior locking teeth 436, and rotating the calendar sleeve 416 to set the correct day on which the pill regimen is starting. In this manner, the calendar sleeve 416 can be disengaged from the outer body 103 and rotated within the outer body 103. For example, and as embodied herein, a first column of day indicators 510*a* on the calendar 416 can align with the group of windows for displaying the indicator 107, and the regimen was started or will start on a Friday 514. If a patient instead starts the regimen on Thursday 512, the patient can adjust the calendar so that a different column of day indicators 510*b*, corresponding to the day of the week on which the regimen starts, aligns with the group of windows for displaying the indicator 107. For example, and as embodied herein, the patient can pull the calendar sleeve 416 to disengage the calendar sleeve 416 from the outer body 103 and rotate the calendar sleeve 416 counterclockwise.

Figure 6C:
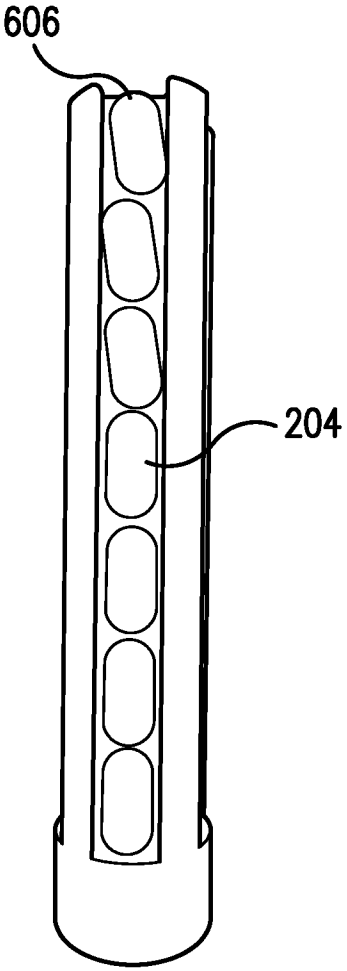
FIG. 6C is a side view of the core of FIG. 6A, illustrating stored pills stacked in a channel of the core.
Figure 6B:
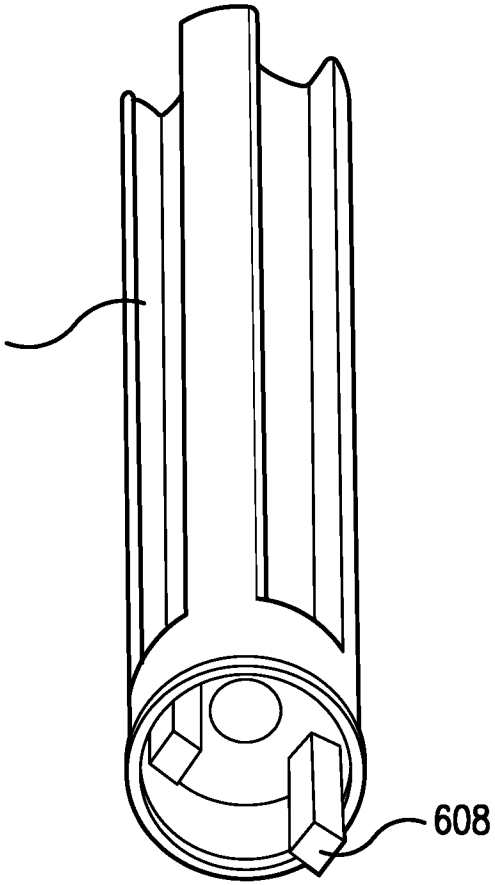
FIG. 6B is a bottom perspective view of the core of FIG. 6A, illustrating exemplary engagement features to engage with a reset knob.
Figure 6A:
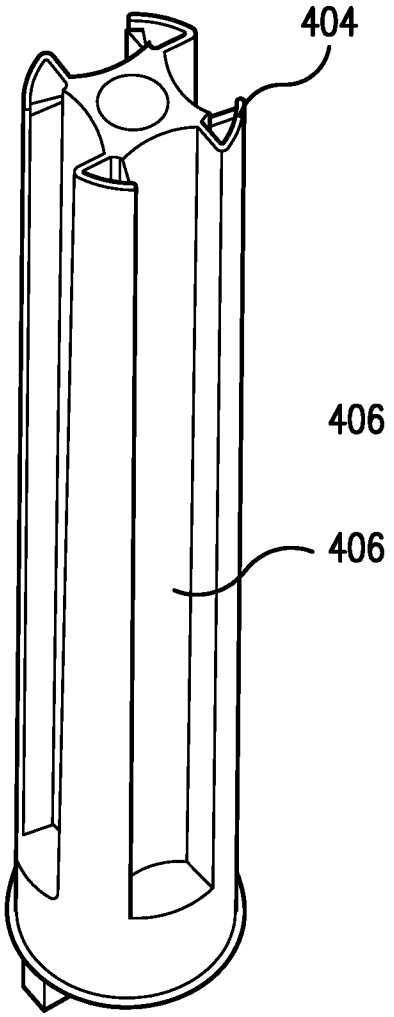
FIG. 6A is a top perspective view of an exemplary core within the dispenser of FIG. 1A.

Referring now to FIGS. 6A-6C, an exemplary core is illustrated. Core 404 can include one or more of channels 406 to store pills 204 within a dispenser. For example, and as embodied herein, core 404 can include a plurality of channels 406 extending along the length of the core 404 and spaced circumferentially about the core 404. As shown for example in FIG. 6C, the pills 204 can be stacked in a column 606 lengthwise along a longitudinal axis aligned with the longitudinal axis of and within each channel 406. As such, a single pill or dose of pills can be removed, as described herein. As embodied herein, the windows can be spaced apart so that each window displays a different pill stacked in a channel, which can allow the windows in the calendar sleeve 416 and outer body to display the correct number of pills remaining within the dispenser. When a channel is depleted of pills, the core can be rotated to align a different set of pills in a second channel to display the pills and allow the pills to be dispensed. For purpose of illustration and not limitation, core 404 can include one or more engagement features to engage with a reset knob, for example and as embodied herein, configured as grooves or rods 608. Although embodiments of FIG. 6 illustrate four channels in a core, any number of channels can be included a core, for example six or eight. For example, a dispenser can be configured to dispense two pills a day (as shown for example in FIG. 1B), and thus the core can include eight channels of weekly pill sets, for a total of 56 pills.

Figure 7A:
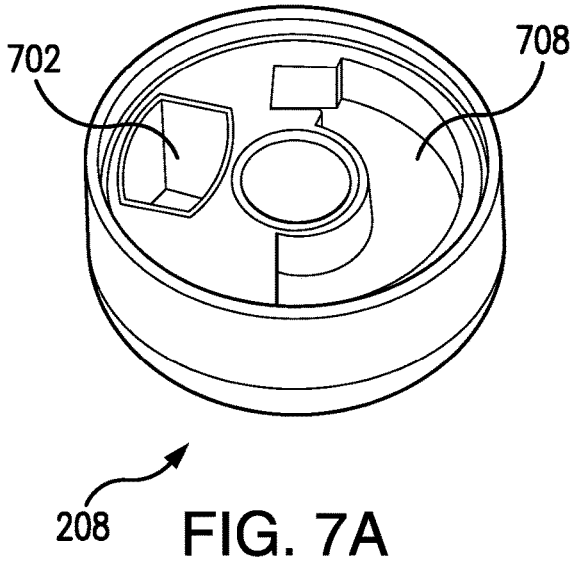
FIG. 7A is a top perspective view of an exemplary actuator of the dispenser of FIG. 1A, according to the disclosed subject matter.
Figure 7B:
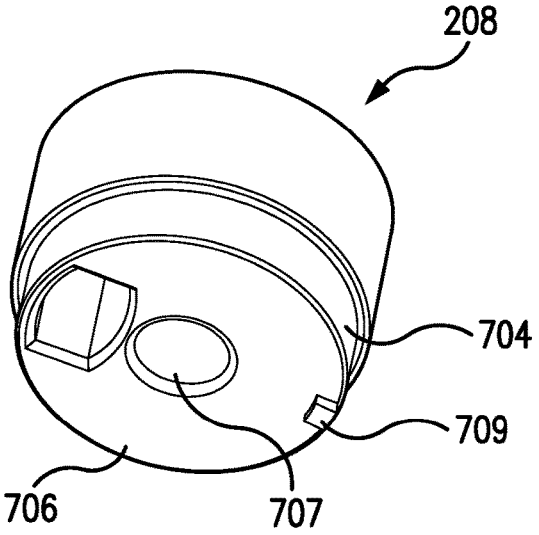
FIG. 7B is a bottom perspective view of the actuator of FIG. 7A.
Figure 7C:
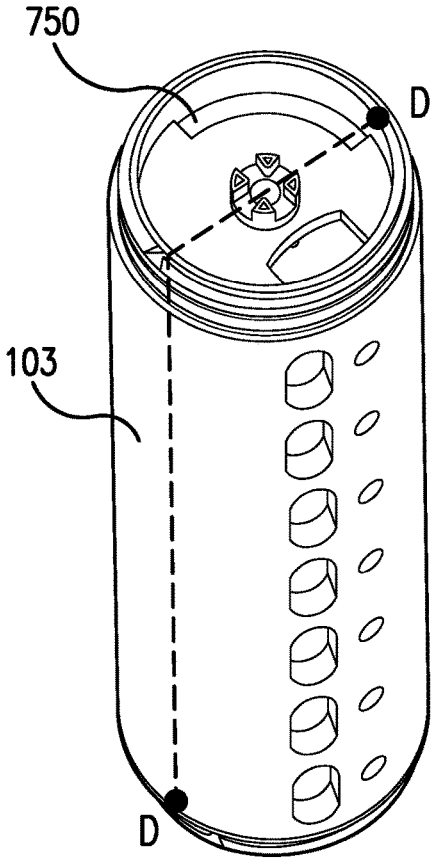
FIG. 7C is a top perspective view of an exemplary outer body of the dispenser of FIG. 1A.
Figure 7D:
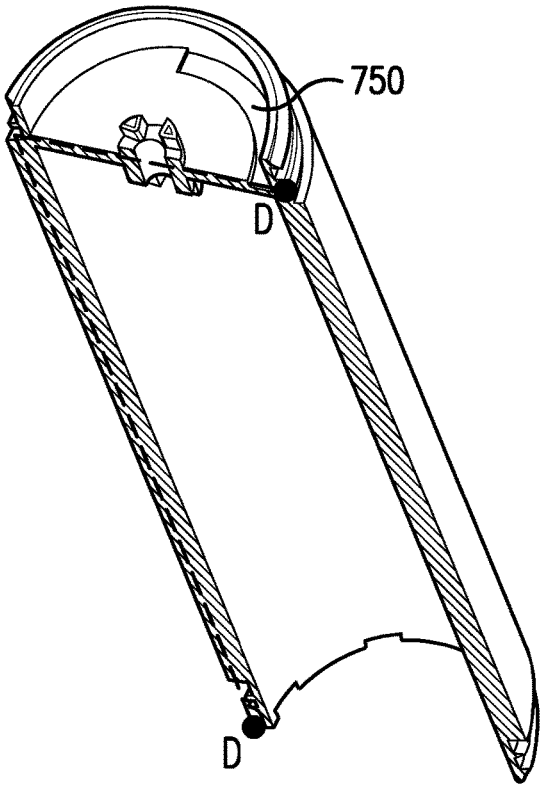
FIG. 7D is a top perspective view of a section of the outer body taken along line D-D of FIG. 7C.

Referring now to FIGS. 7A-7F, an exemplary actuator, actuator cover 410, and outer body 103 are illustrated. With reference to FIGS. 7A-7B, for purpose of illustration and not limitation, and as embodied herein, an actuator 208 can include a slot 702 to allow a pill to be dispensed therethrough from the core's channel 406 (as shown for example in FIG. 4). Slot 702 can be sized to receive a whole pill within the actuator 208. As embodied herein, the actuator 208 can at least partially engage the outer body 103 of the dispenser, for example by an interlocking engagement of inner lip 704 disposed proximate the bottom side 706 of the actuator 208 with the outer body 103. For example, and as embodied herein, a groove 708 can be sized to receive a spring, which can allow the actuator to automatically return to an original position after it is rotated by a patient to dispense a pill, as described herein. Actuator 208 can also be configured to mate with outer body 103 through a stopper 709 protruding from the bottom side 706 of the actuator, which can align the slot 702 with a channel of the core (e.g., channel 406 as shown in FIG. 4). With reference to FIGS. 7C and 7D, as embodied herein, an outer body 103 can include a groove 750 to receive the stopper 709 of the actuator 208. As shown in FIG. 7D, the groove 750 can present or inhibit movement of the actuator 208 beyond a predetermined amount of rotation, for example and as embodied herein, 90 degrees of rotation. Other degrees of rotations may be desired, for example, based on the arrangement of the channels in the core.

Figure 7E:
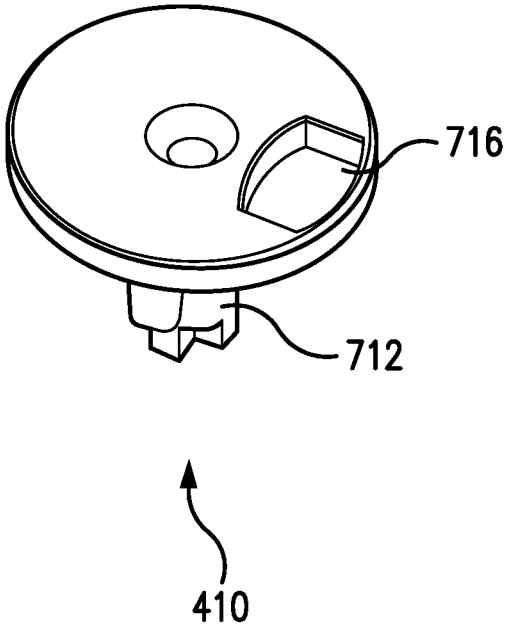
FIG. 7E is a top perspective view of an exemplary actuator cover of the dispenser of FIG. 1A.
Figure 7F:
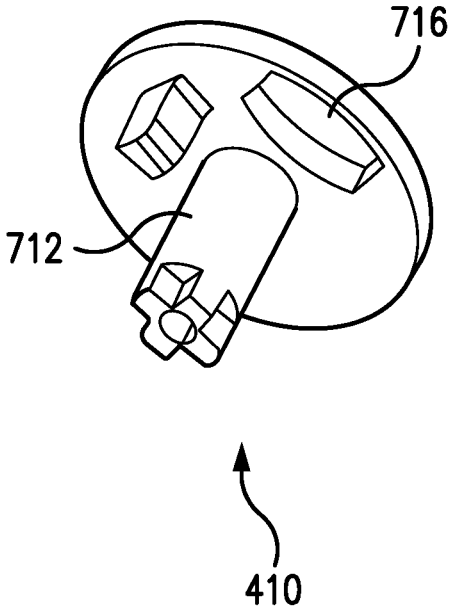
FIG. 7F is a bottom perspective view of the actuator cover of FIG. 7E.

With reference to FIGS. 7E-7F, as embodied herein, an actuator cover 410 can be joined with the actuator 208, for example by inserting locking rod 712 into an aperture 707 within the actuator (aperture 707 shown at FIG. 7B). As embodied herein for illustration and not limitation, locking rod 712 can be locked with shaft 412 (shown in FIG. 4) to allow the actuator 208 to rotate about the locking rod 712. Actuator cover 410 can lock with the shaft through actuator 208 proximate the top side of the actuator 208. The actuator cover 410 can include an opening 716 to allow the pill dispensed into the actuator's slot 702 to pass through the actuator cover 410 and out of the dispenser. For example, and as embodied herein, opening 716 can be aligned with slot 702 when the actuator 208 is in a storage position. Furthermore, and as embodied herein, the opening 716 can have a similar size and shape as slot 702.

Figure 8B:
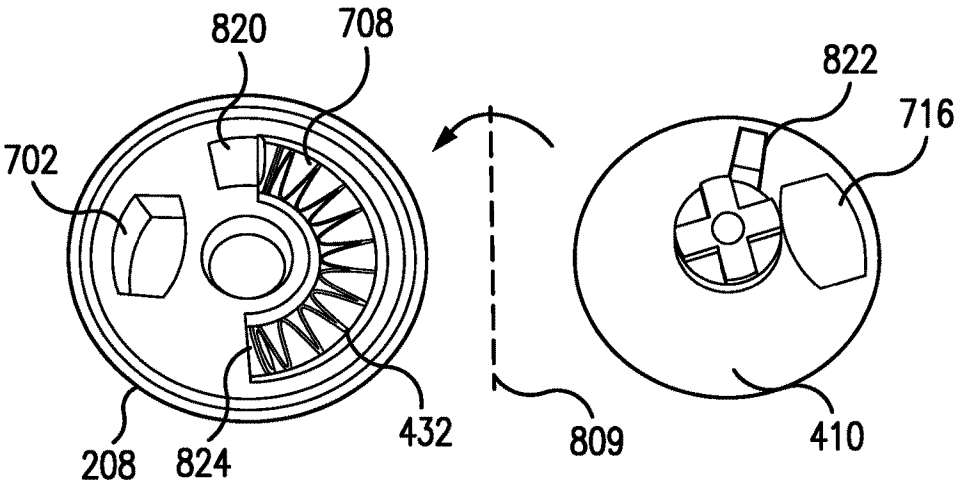
FIG. 8B is a comparative bottom and top view of an actuator and actuator cover assembly of the dispenser of FIG. 1A to depict the relative positions of the two components.
Figure 8C:
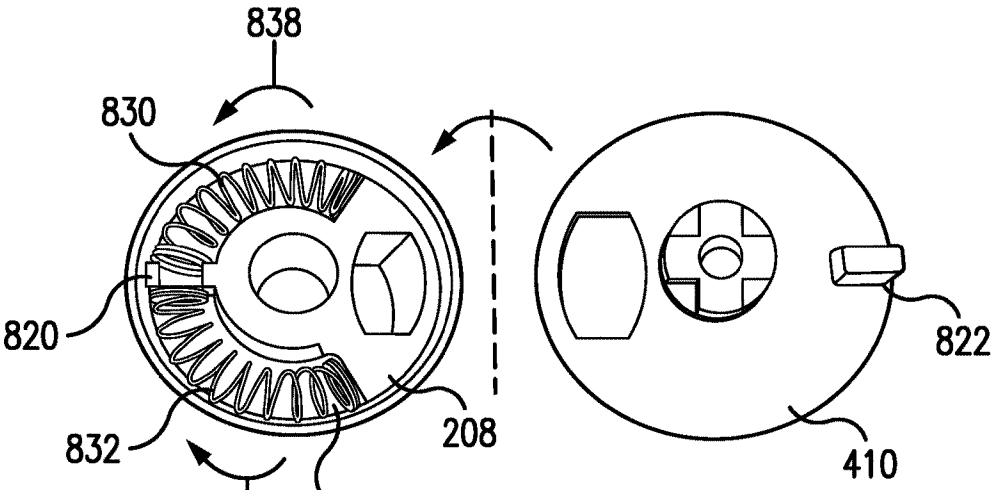
FIG. 8C is a comparative bottom and top view of an actuator and actuator cover assembly of the dispenser of FIG. 1B to depict the relative positions of the two components.
Figure 8A:
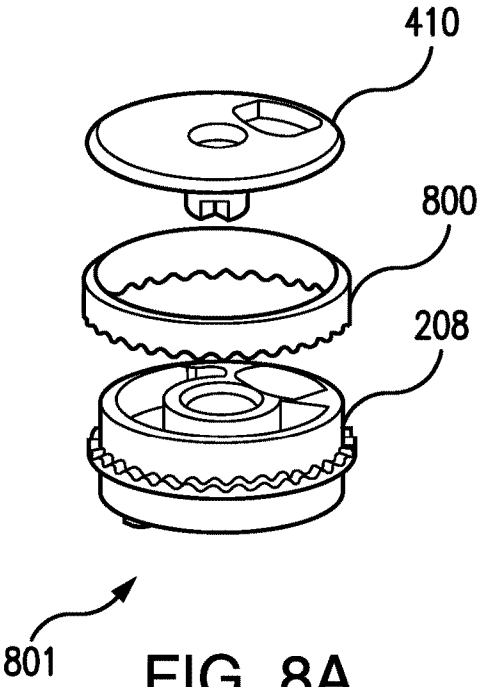
FIG. 8A is an exploded view of an exemplary actuator and actuator cover assembly of the dispenser of FIG. 1A or FIG. 1B, in accordance with the disclosed subject matter.

Referring now to FIGS. 8A-8C, an exemplary actuator and actuator cover assembly is illustrated. In accordance with another aspect of the dispenser disclosed herein, actuator and actuator cover assembly 801 can be provided with a feature to include a grooved ring 800 disposed between actuator cover 410 and actuator 208. For example and not limitation, the dispenser can inhibit or prevent tampering with the dispenser, such as by young children. In this manner, pressing the actuator 208 down to disengage the actuator 208 from the grooves of the grooved ring 800 can allow the actuator 208 to be turned to dispense a pill. Other tamper-resistant configurations can be possible.

With reference to FIG. 8B, at 806, for purposes of illustration and not limitation, when actuator and cover assembly 801 is flipped upside down across symmetry line 809, it can be seen that an opening 716 in the actuator cover 410 is aligned with a slot 702 in the actuator 208 when the actuator 208 is in a storage position. As embodied herein, a spring 432 can be disposed within a circumferential groove 708 within the actuator 208. The spring 432 can be preloaded within the circumferential groove 708 to draw the actuator toward a storage position. The actuator 208 can include a recess 820 of the groove sized to receive a nub 822 disposed on the corresponding side of the actuator cover 410. The actuator 208 thus can be rotated by a patient about its center axis, and the actuator cover 410, which can be locked with a shaft, can be inhibited from rotating with the actuator 208. In this manner, spring 432 can be compressed against the nub 822. With the nub 822 rotated to a position proximate the end of the groove 824, the slot of the actuator 208 can be aligned with one of the channels in the core. In this dispensing position, tilting downward of the top of the dispenser can allow a pill to drop out of the channel, through the actuator slot 702, and out of the dispenser. With the actuator rotated out of the storage position, slot 702 is not aligned with opening 716 in the actuator cover 410. As such, the dispensed pill in the actuator slot can be stopped by the actuator cover 410 to prevent a pill from being dispensed. When the spring 432 is released, with the nub 822 within recess 820, the actuator 208 is biased toward the storage position. That is, in the dispensing position, with the spring

432 compressed at the end of the groove, the spring can urge the actuator 208 back toward the storage position when rotational force toward the dispensing position is no longer applied to the actuator 208, for example and as embodied herein, by the patient releasing their hand from the actuator 208. In the storage position, the slot 702 can again be aligned with the opening 716 in the actuator cover 410 and offset from the channel.

Referring now to FIG. 8C, an actuator 208 and cover assembly 801 for a dispenser configured to dispense two pills a day is provided. For the purpose of illustration and not limitation, reference is made to the dispenser of FIG. 1B. In a dispenser 100*b* configured to dispense two pills a day, as discussed herein with respect to FIG. 1B, the actuator 208 and actuator cover assembly 801 can be configured to rotate in two opposite directions to a first dispensing position and to a second dispensing position, each to dispense a different pill. For example, and as embodied herein, this embodiment, two springs 830 and 832 can be disposed within circumferential groove 708 in the actuator 208, each spring 830 and 832 extending in opposing circumferential directions. A recess 820 can be formed proximate the center of groove 708 to provide space for the nub 822 on the corresponding size of the actuator cover 410. In this manner, the actuator 208 can rotate in two opposite directions 836 and 838 relative the storage position to two dispensing positions, and the corresponding spring 830 and 832 when compressed can urge the actuator 208 to return to the storage position.

Figure 9B:
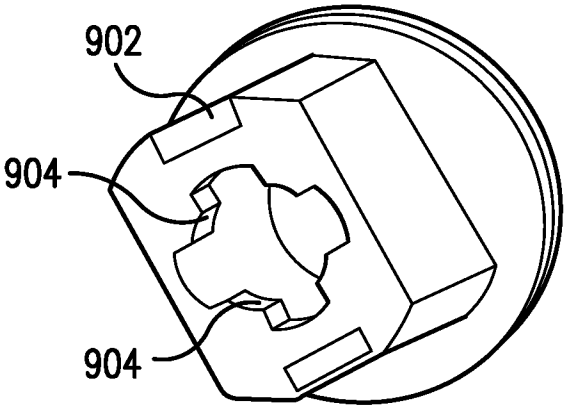
FIG. 9B is a bottom perspective view of the reset knob of FIG. 9A.
Figure 9C:
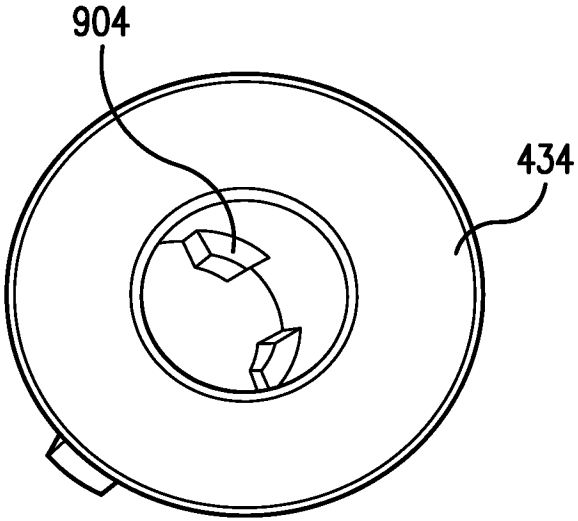
FIG. 9C is a top perspective view of the reset knob of FIG. 9A, according to an illustrative embodiment of the disclosed subject matter.
Figure 9A:
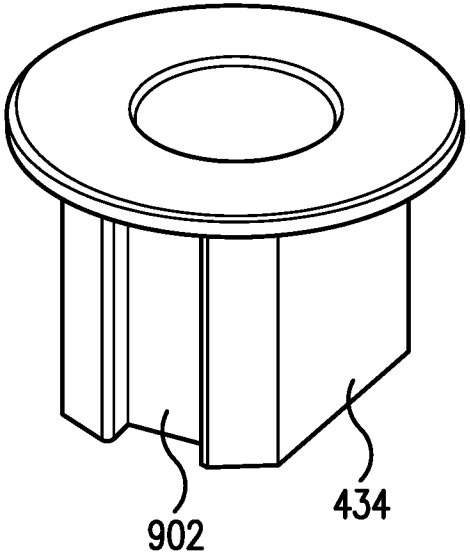
FIG. 9A is a perspective view of an exemplary reset knob of the dispenser of FIG. 1A or 1B.

With reference to FIGS. 9A-9C, an exemplary reset knob is illustrated. For example, and as embodied herein, reset knob 434 can include grooves 902 sized to engage one or more engagement features of the core to rotate the core upon rotation of the knob 434. Engagement features may be configured as grooves or rods 608 as shown in FIG. 6B, for example. Reset knob 434 can include a gripping feature, for example and as embodied herein, configured as a gripping flange. Additionally, and as embodied herein, reset knob 434 can include teeth 904 configured to engage shaft 412 (as shown in FIG. 4 and FIG. 11 for example) to prevent rotation of reset knob 434 until reset knob is disengaged from the shaft, for example by pulling the reset knob outward from the bottom of the dispenser, as described herein.

Figure 10:
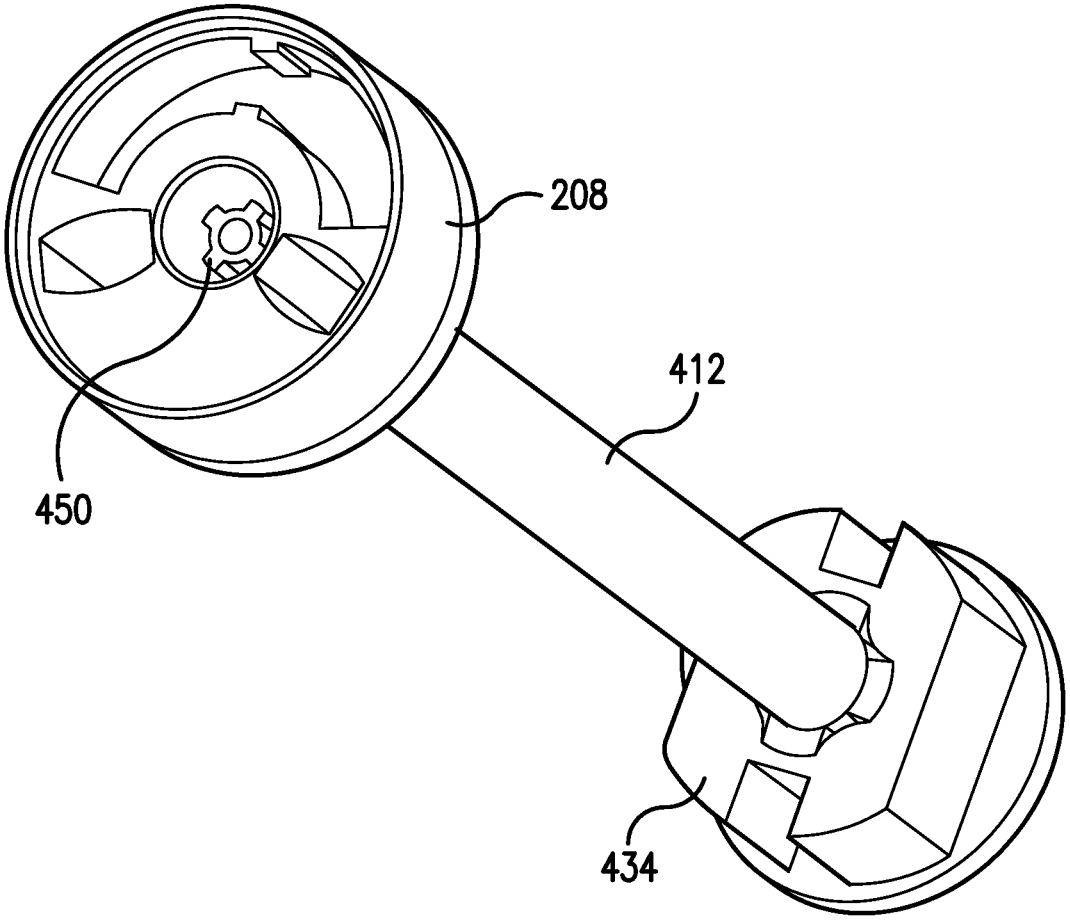
FIG. 10 is a perspective view of an exemplary knob holder, reset knob, and actuator assembly in accordance with the disclosed subject matter.

Referring now to FIG. 10, an exemplary shaft, reset knob and actuator assembly is illustrated. For example, and as embodied herein, reset knob 434 can be engage shaft 412 at one end, while the shaft is locked with an actuator cover (not shown) on the opposing end 450 of the shaft 412, through actuator 208. Reset knob 434 can be releasable from the shaft 412 while remaining engaged with the core, as described herein.

Figure 11:
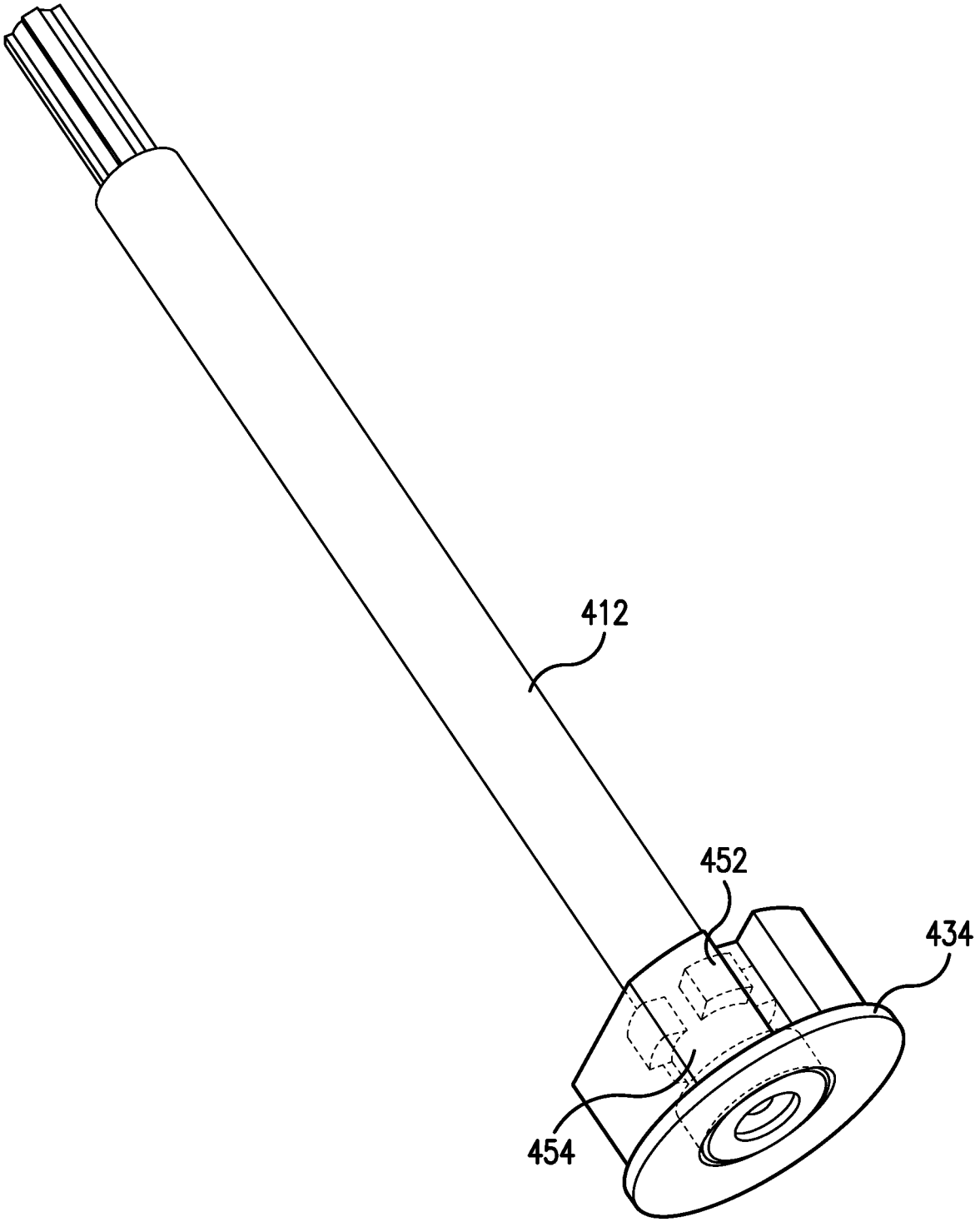
FIG. 11 is a perspective view of an exemplary knob holder and reset knob assembly in accordance with the disclosed subject matter.

With reference to FIG. 11, an exemplary knob holder and reset knob assembly is illustrated. For purpose of illustration and not limitation, as embodied herein, teeth 452 spaced circumferentially about shaft 412 can protrude radially therefrom. When the reset knob is pushed into the dispenser, teeth 452 can engage grooves 902 on the knob (as shown for example in FIG. 9). When a patient pulls the reset knob 434 out from the dispenser, as described herein, grooves 902 in the reset knob can be pulled out of circumferential alignment with teeth 452, and thus reset knob 434 can be free to rotate about shaft 412 in recess 454 spaced along the shaft 412 from teeth 452. In this manner, reset knob 434 can engage the core through grooves 902 while being free to rotate unlocked from the shaft 412.

For purpose of illustration and not limitation, each of the dispenser's components or parts can be made of a variety of suitable materials, including compatible plastic, polymers, composites or the like. The components can be manufactured by recognized techniques, including but not limited to injection molding, in-mold labeling, casting, milling, 3D printing or the like. A wide variety of dimensions and ergonomic shapes and features (such as surface texture, flexibility, size, weight, color, etc.) can be used as desired and suitable for the intended use.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. An apparatus for dispensing pills, comprising:

an outer body comprising a set of outer windows for displaying one or more pills within the dispenser;

a core disposed within the outer body, the core including a plurality of channels to store the one or more pills, wherein the channels extend along the length of the outer body;

a calendar sleeve placed between the outer body and the core, wherein the calendar sleeve includes a column of pill windows and a day indicator associated with each window in the column of windows, wherein the column of windows aligns with at least some of the outer windows on the outer body and further aligns with one of the channels in the core;

an actuator including a slot, the actuator joined to the outer body at a first end and rotatable about the core from a storage position to a first dispensing position with the slot aligned with a first channel, and rotatable from the storage position to a second dispensing position with the slot aligned with a second channel; and an actuator cover joined to the actuator and including an opening configured to align with the slot when the actuator is in the storage position.

2. The apparatus of claim 1, wherein the actuator is rotatable in a first direction to the first dispensing position and rotatable in an opposite direction to the second dispensing position.

3. The apparatus of claim 1, comprising two springs disposed within a circumferential groove in the actuator, each spring extending in opposing circumferential directions.

4. The apparatus of claim 3, wherein each of the springs returns the actuator to the storage position after being rotated to the first or second dispensing positions.

5. A dispenser, comprising:

an outer body to display one or more pills within the dispenser;

a core disposed within the outer body, the core including a channel extending along a length of the outer body to store the one or more pills within the channel;

an actuator including a slot, the actuator joined to the outer body at a first end and rotatable about the core from a storage position to a dispensing position with the slot aligned with the channel; and an actuator cover joined to the actuator and including an opening configured to align with the slot when the actuator is in the storage position, wherein the outer body includes a first column of outer windows that are configured to be aligned with the channel of the core, wherein the outer windows are configured to display the one or more pills therethrough.

6. The dispenser of claim 5, wherein the stored pills are dispensed through the actuator slot and the opening of the actuator cover.

7. The dispenser claim 5, wherein the dispenser is configured to be tilted to dispense a single pill from the stored one or more pills.

8. The dispenser of claim 5, wherein the outer body includes a second column of outer windows that are configured to display an indicator proximate each window of the first column of outer windows.

9. The dispenser of claim 5, wherein the core includes a plurality of channels extending along a length of the outer body, the plurality of channels spaced apart about the circumference of the core, each configured to store one or more pills.

10. The dispenser of claim 5, wherein the groove includes a recess to receive a nub disposed on a corresponding side of the actuator cover.

11. The dispenser of claim 5, wherein the actuator cover includes a locking rod that is inserted into an aperture within the actuator.

12. The dispenser of claim 5, wherein the actuator includes a groove, wherein at least one spring is disposed within the groove.

13. The dispenser of claim 12, wherein the spring is configured to return the actuator to a storage position after the actuator is rotated to the dispensing position.

14. A dispenser, comprising:

an outer body to display one or more pills within the dispenser;

a core disposed within the outer body, the core including a channel extending along a length of the outer body to store the one or more pills within the channel;

an actuator including a slot, the actuator joined to the outer body at a first end and rotatable about the core from a storage position to a dispensing position with the slot aligned with the channel;

an actuator cover joined to the actuator and including an opening configured to align with the slot when the actuator is in the storage position, and a calendar sleeve disposed between the outer body and the core, the calendar sleeve including one or more columns of pill windows and an indicator disposed proximate each pill window.

15. The dispenser of claim 14, wherein the outer body comprises:

a first column of outer windows configured to be aligned with one of the columns of pill windows; and a second column of outer windows configured to be aligned with the corresponding indicators of the pill windows.

16. The dispenser of claim 14, wherein the calendar sleeve includes teeth configured to engage corresponding teeth of the outer body.

17. The dispenser of claim 16, wherein the calendar sleeve is rotatable within the outer body when the teeth are disengaged from the corresponding teeth of the outer body.

18. A dispenser, comprising:

an outer body to display one or more pills within the dispenser;

a core disposed within the outer body, the core including a channel extending along a length of the outer body to store the one or more pills within the channel;

an actuator including a slot, the actuator joined to the outer body at a first end and rotatable about the core from a storage position to a dispensing position with the slot aligned with the channel;

an actuator cover joined to the actuator and including an opening configured to align with the slot when the actuator is in the storage position;

a shaft disposed within the core; and a knob configured to engage with the core proximate an opposing end of the outer body and releasably engage with the shaft.

19. The dispenser of claim 18, wherein the actuator cover engages the shaft at the first end of the dispenser.

20. The dispenser of claim 18, wherein, when the knob is disengaged from the shaft, the knob is rotatable by a user to rotate the core to align a selected channel with the actuator's slot when the actuator is in a dispensing position.

21. The dispenser of claim 18, wherein the shaft includes teeth spaced circumferentially around the shaft and protruding radially therefrom.

22. The dispenser of claim 21, wherein the knob includes teeth configured to be releasably engaged with the teeth spaced circumferentially around the shaft.

* * * * *